United States Patent [19]

Iwatani et al.

[11] Patent Number: 4,803,377

[45] Date of Patent: Feb. 7, 1989

[54] STARTER MOTOR CONTROL DEVICE FOR ENGINES

[75] Inventors: Shiro Iwatani; Kazuya Tokugawa, both of Himeji, Japan

[73] Assignee: Mitsubishi Denki Kabushiki Kaisha, Tokyo, Japan

[21] Appl. No.: 169,274

[22] Filed: Mar. 17, 1988

[30] Foreign Application Priority Data

Mar. 18, 1987 [JP] Japan ..... 62-40554[U]

[51] Int. Cl.[4] ..... F02N 11/08

[52] U.S. Cl. ..... 290/38 R

[58] Field of Search ..... 290/38 R, 38 C, 38 E, 290/48, DIG. 1, DIG. 3; 123/179 R

[56] References Cited

U.S. PATENT DOCUMENTS 4,045,062 8/1977 Disosway, III et al. ..... 290/38 R
4,070,585 1/1978 Parkyn ..... 290/38 R X
4,415,812 11/1983 Griffith et al. ..... 290/38 R
4,490,620 12/1984 Hansen ..... 290/38 R

FOREIGN PATENT DOCUMENTS 54-40698 12/1979 Japan .
56-9654 1/1981 Japan .

*Primary Examiner*—William M. Shoop, Jr.
*Assistant Examiner*—W. E. Duncanson, Jr.
*Attorney, Agent, or Firm*—Oblon, Fisher, Spivak, McClelland & Maier

[57] ABSTRACT

A starter motor control device comprising a starter motor for starting an engine, an auxiliary switch which can interrupt the energization to the starter motor, a circuit for detecting the rotation speed of the engine or other mechanism related to the rotation speed of the engine to output a signal for preventing the starter motor from being conversely driven by the started engine, a circuit for restraining the starter motor from being energized again for a predetermined time just after the energize to the starter motor is cutoff, a first detecting means having a first set value for judging the voltage at an auxiliary switch driving terminal of a switching element for driving the auxiliary switch, a second detecting means having a second set value for judging the voltage of the auxiliary switch driving terminal, and a circuit for determining the operation of the switching element based on the judgements given by the first and the second detection means.

1 Claim, 2 Drawing Sheets

STARTER MOTOR CONTROL DEVICE FOR ENGINES

BACKGROUND OF THE INVENTION

1. Field of the Invention

The present invention relates to a starter motor control device for engines, which detects the rotation speed of an ac generator and the like driven by an engine and also detects the energizing state of a starter motor for starting the engine so as to control the energization of the starter motor.

2. Discussion of Background

Such kind of starter motor control devices have been known in e.g. Japanese Examined Patent Publication No. 40698/1979 and Japanese Unexamined Patent Publication No. 9654/1981.

FIG. 2 shows a circuit diagram in one of the conventional control devices. In FIG. 2, a reference numeral 1 designates a storage battery, and a reference numeral 2 refers to a starter motor for starting an engine (not shown).

The starter motor 2 comprises an electromagnetic switch 21 and an electric motor unit 22, and is connectable to the engine through pinion (not shown).

The electromagnetic switch unit 21 includes relay coils 21*a* and 21*b*, and a normally open contact 21*c*. The contact 21*c* and the electric motor unit 22 make a series circuit, and the series circuit is connected in parallel with the storage battery 1. The negative terminal of the battery 1 is grounded.

A reference numeral 3 designates an auxiliary switch unit which comprises a relay coil 3*a* and a normally open contact 3*b* to be capable of interrupting the energization to the starter motor 2. The contact 3*b* and the relay coil 21*a* of the electromagnetic switch unit 21 make a series circuit, and the series circuit connected in parallel with the battery 1. The relay coil 21*b* in the electromagnetic switch unit 21 is connected between the point at which the contact 3*b* and the relay coil 21 are jointed and the point at which the contact 21*c* and the electric motor unit 22 are jointed.

The positive terminal of the battery 1 is connected to a movable contact of a key switch 6. The key switch 6 can take three positions, i.e. an off position (OFF), an on position (ON) and a start position (ST). In the off position, the key switch is open. In the on position, it is grounded through a power supply terminal 4*a*, a resistor 402 in a control device 4 and a Zener diode 401. In the start position, the key switch 6 is connected to the collector of a transistor 410 as a switching element of the control device 4, through the relay coil 3*a* of the auxiliary switch 3 and an auxiliary switch driving terminal 4*d*. The Zener diode 401 serves to give a constant voltage source.

The control device 4 is to carry out operation control for the auxiliary switch 3. In the control device 4, voltage dividing resistors 403 and 404 are connected in series between a power supply terminal and grounded. The point at which the resistors 403 and 404 are jointed is connected to the noninverting input of a comparator 409. The resistors 403 and 404 serve to provide a first reference voltage for the comparator 409.

The noninverting input of the comparator 409 is connected to the point at which the contact 3*b* of the auxiliary switch unit 3 and the relay coil 21*a* of the electromagnetic switch unit 21 are jointed, through a resistor 405 and a terminal 4*e* for detecting the conducting state of the auxiliary switch. The resistor 405 is used to detect whether the auxiliary switch 3 is in the conducting state or in the nonconducting state. When the auxiliary switch 3 is in the conducting state, the resistors 405 and the resistor 404 constitute voltage dividing resistors to provide a second reference voltage for the comparator 409.

The noninverting input of the comparator 409 is grounded through a reverse-current prevention diode 406 and a resistor 407. The point at which the reverse-current prevention diode and the resistor 407 are jointed is connected to the inverting input of the comparator 409.

The resistor 407 is in parallel with a capacitor 408. The resistor 407 and the capacitor 408 constitute a discharge time constant circuit.

The output of the comparator 409 is connected to the base of the transistor 410. The transistor 410 is used to drive the auxiliary switch 3. The base of the transistor 410 is connected to the power supply through a base resistor 411. The emitter of the transistor 410 is grounded through a grounding terminal 4*c*.

A reference numeral 40 designates an F-V converter which detects the rotation pulse of a generator 5 as described later and converts the pulse frequency into a voltage. The output of the F-V converter 40 is connected to the inverting input of a comparator 414.

The noninverting input of the comparator 414 is connected to the point at which voltage dividing resistors 412 and 313 are jointed. The resistors 412 and 413 are connected in series between the power supply and ground. A voltage that is divided by the resistors 412 and 413 is applied to the noninverting input of the comparator 414 to provide a reference voltage for it. The output of the comparator 414 is connected to the base of the transistor 410. The control unit 4 is constituted in this way.

The generator 5 is driven by the engine to provide power for each electric load. The generator 5 comprises an alternator unit 51 and a rectifier unit 52. The rectifier unit 52 has a rotation detecting terminal 4*b* connected to the input of the F-V converter 40.

In operation, in preparing for starting the engine, the key switch 6 is set to the on position to provide power for the control device 4. At this time, the auxiliary switch 3 has not been energized, so the starter motor 2 has not been driven and the engine remains standstill.

Since the rotation pulse is not given from the generator 5, the output of the F-V converter 40 is at 0 v, which is input into the inverting input of the comparator 414. On the other hand, the noninverting input of the comparator 414 receives the reference voltage given by the voltage dividing resistors 412 and 413, which is set to correspond to a predetermined rotation speed. As a result, the output of the comparator 414 is "high".

The noninverting input of the comparator 409 receives the first reference voltage given by the resistors 403 and 404. On the other hand, the inverting input of the comparator receives a voltage which is lower than the voltage applied to the noninverting input by a forward direction voltage drop (0.6 v) of the diode 409. As a result, the output of the comparator 409 is "high". That allows the transistor 410 for driving the auxiliary switch 3 to conduct.

When the key switch 6 is set to the start position, the power is applied to the relay coil 3*a* in the auxiliary switch 3. Since the transistor 410 is in conduction at this time, the relay coil 3*a* is energized to close the contact 3*b*.

Thus, the starting motor 2 is energized and the pinion of the motor gets into engagement with the flywheel teeth of the engine to start the engine. As a result, the rotation pulse frequency from the generator 5 is increasing to raise the output voltage of the F-V converter 40.

On the other hand, it is detected by the terminal 4*e* that the auxiliary switch 3 is closed. The noninverting input in the comparator 409 receives the second reference voltage given by the resistors 405 and 404.

The second reference voltage is set to be higher than the first reference voltage given by the resistors 403 and 404. As a result, the capacitor 408 which is connected to the inverting input of the comparator 409 is charged to a higher voltage accordingly. However, the potential difference between the noninverting and the inverting input remains unchanged to maintain the "high" output of the comparator 409.

After that, when the engine reaches the predetermined rotation speed (it means that the engine has completely started), i.e. when the output voltage of the F-V comparator 40 reaches the same voltage as the reference voltage applied to the noninverting input of the comparator 414, the output of the comparator 414 drops to "low" and the transistor 410 is cut off to open the auxiliary switch 3.

As a result, the starter motor 2 is deenergized to disengage the pinion from the flywheel teeth of the engine. This prevents the starter motor 2 from being conversely driven by the engine to be damaged by overrotation.

Now, it will be considered a case where the key switch 6 is returned from the start position to the on position and is set to the start position again before the engine has completely started.

The inverting input of the comparator 409 is held at the higher voltage by the capacitor 408 for the instant the key switch is returned to the on position.

On the other hand, the noninverting input of the comparator 409 is changed to the lower voltage or the first reference voltage given by the resistors 403 and 404. As a result, the output of the comparator 409 drops to "low" to cut off the transistor 410.

After that, the capacitor 408 discharges through the resistor 407. The transistor 410 is held at cutoff until the inverting input of the comparator 409 drops to the first reference voltage or below, which is applied to the inverting input.

The cutoff-state duration of the transistor is determined by CR time constant of the capacitor 408 and the resistor 407. It is generally set to 3–5 seconds which is the time required for the starter motor 2 to cease its inertial rotation.

For the reasons, even if the key switch is set to the start position again during this time, the auxiliary switch 3 is held at the open state to prevent the starter motor 2 from being energized. This prevents the inertially rotating pinion of the starter motor 2 from being damaged due to the engagement with the flywheel teeth of the engine.

In the conventional devices having such structure, even if the starter motor 2 is energized while the starter motor 2 is rotating by inertia, the pinion of the starter motor is prevented from moving into mesh with the flywheel teeth. That, however, requires the terminal 4*e* for detecting the conducting state of the auxiliary switch. The control device needs totally five terminals including other terminals.

Since, in general, standard connectors have four or six pins, it is necessarily forced to adopt the six pin type of connectors. This is disadvantageous in terms of quality, cost, and the necessity of additional wire-harness.

Although there is proposed an idea of constituting the auxiliary switch 3 and the control device 4 as one unit to compensate for the drawbacks as mentioned above, it must be considered to be necessary to modify the auxiliary switch 3 depending on the power required to the starter motor 2, and to modify each of set values in the control device 4 depending on the engine power.

The control device which is constituted as one body with the auxiliary switch has disadvantage that it is necessary to extremely increase the number of the types to meet plenty of requirements and that it is difficult to standardize the device.

Since the conventional device has the structure as mentioned above, there must be provided the terminal for detecting the conducting state of the auxiliary switch 3 and an additional wire-harness to be connected to the terminal in order to enable to interrupt the energization to the starter motor 2 while the starter motor is rotating by inertia. If the auxiliary switch 3 and the control device 4 are constituted as one unit in order to prevent the terminal and harness from being added, there is disadvantage that it is necessary to increase the number of the types of the device to meet various requirements.

SUMMARY OF THE INVENTION

It is an object of the present invention to eliminate the disadvantage of the conventional device and to provide a new and improved starter motor control device for engines capable of offering a similar function to the conventional device without the provision of the terminal for detecting the conducting state of the auxiliary switch and the harness for it.

It is another object of the present invention to provide a starter motor control device for engines capable of offering a similar function to the conventional device without constituting the auxiliary switch and the control device as one unit, thereby enabling to design and manufacture the auxiliary switch and the control device independently.

It is a further object of the present invention to provide a starter motor control device for engines capable of facilitating the accommodation in terms of standardization and maintenance.

The foregoing and the other object of the present invention have been attained by providing a starter motor control device for engines comprising a first detecting means and a second detecting means which judge a voltage at the terminal for driving an auxiliary switch which can interrupt the energization to the starter motor, and determine the operation of the auxiliary switch based on the results of the judgements.

In accordance with the present invention, when the first detecting means detects that the voltage at the terminal for driving the auxiliary switch is a first set value or below, or when the second detecting means detects that the voltage at the terminal is a second set value or above, the auxiliary switch is controlled to remain open for a predetermined time. When the voltage at the terminal is between the first set value and the second set value, the auxiliary switch is controlled to be closed to start the starter motor.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
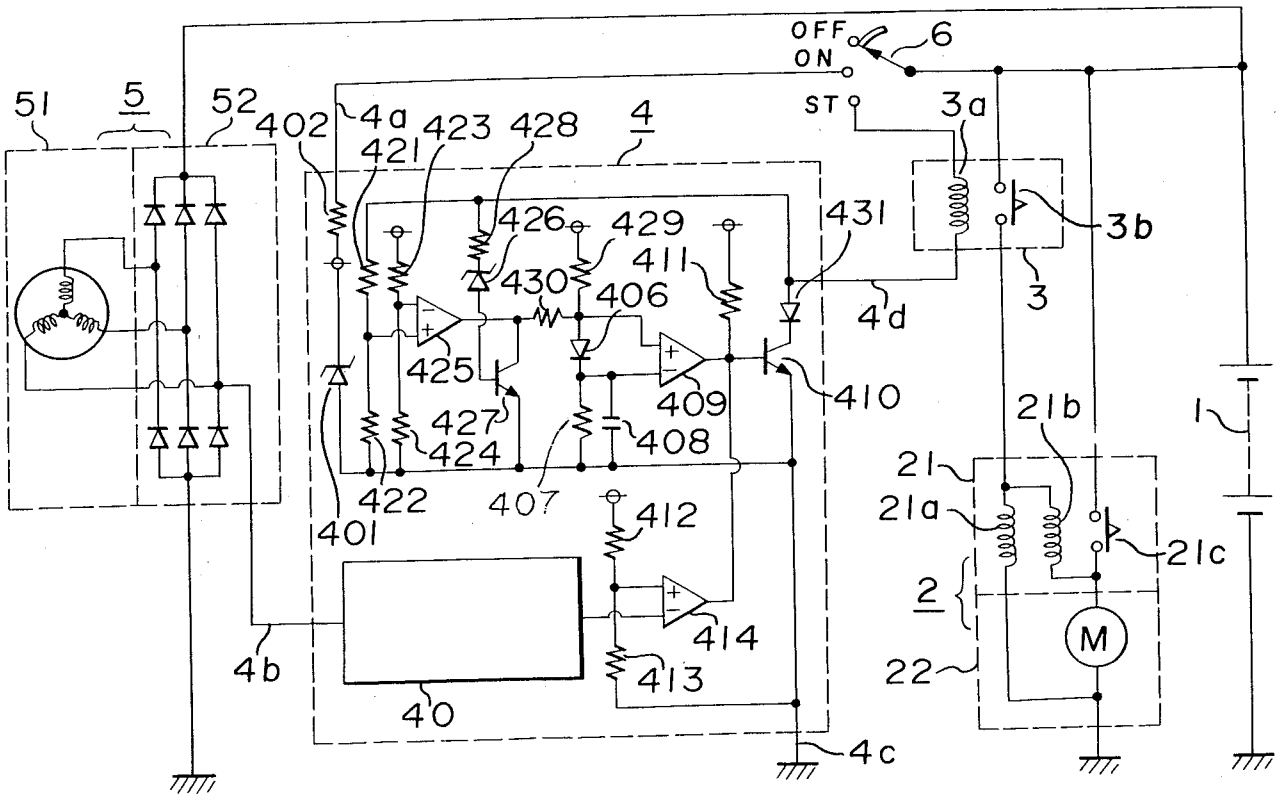
FIG. 1 is a circuit diagam showing an embodiment of the starter motor control device for engines according to the present invention.

Now, an embodiment of the starter motor control device for engines according to the present invention will be described in reference to the drawings. FIG. 1 is the circuit diagram showing the structure of the embodiment. In the figure, the reference numerals as those in FIG. 2 designate identical or corresponding parts as discussed in respect to the convertional device. Explanations on the parts indicated by the like reference numerals will be omitted for simplification.

Figure 2:
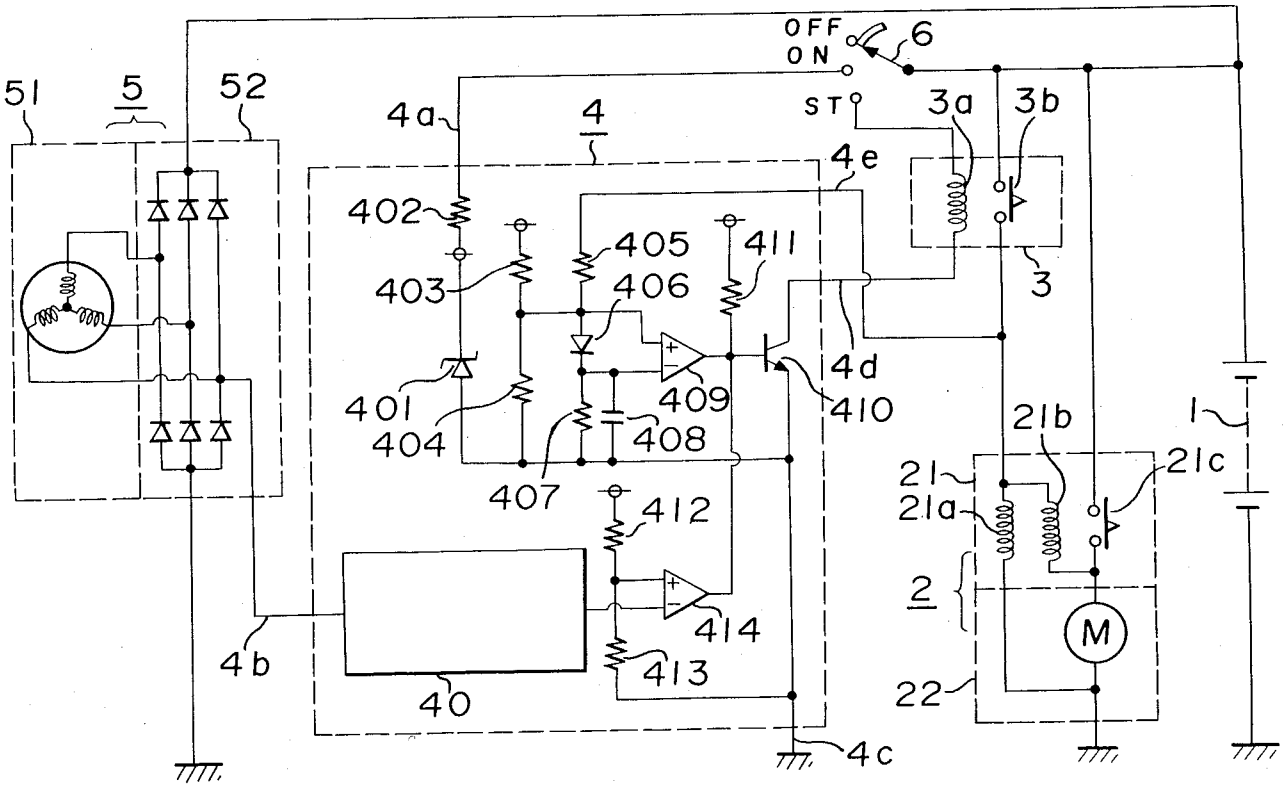
FIG. 2 is a circuit diagram showing the conventional starter motor control device for engines.

As can be seen from the comparison of FIG. 1 with FIG. 2, FIG. 1 is different from FIG. 2 in that a control device 4 has a different structure, i.e. that a terminal **4*d* for driving an auxiliary switch is connected to the collector of a transistor 410 through a diode 431**.

The terminal **4*d* is grounded through voltage dividing resistors 421 and 422. The point at which the resistors 421 and 422 are jointed is connected to the noninverting input of a comparator 425** to apply the divided voltage to the noninverting input.

Voltage dividing resistors 423 and 424 are connected in series between a power supply and ground. The point at which the resistors 423 and 424 are jointed is connected to the inverting input of the comparator 425. The resistors 423 and 424 divide the constant voltage to apply the divided voltage as a reference voltage to the inverting input of the comparator 425.

The comparator 425, and the resistors 421–424 constitute a first detecting means for detecting a voltage at the terminal **4*d* for driving the auxiliary switch 3**.

The terminal **4*d* is also connected to the base of a transistor 427 through a base resistor 428 and a Zener diode 426. The emitter of the transistor 427 is grounded, and the collector is connected to the output of the comparator 425**.

The base resistor 428, the Zener diode 426 and the transistor 427 constitute a second detecting means for detecting a voltage at the terminal **4*d* for driving the auxiliary switch 3**.

The collector of the transistor 427 is connected to the power supply through voltage dividing resistors 429 and 430. The resistors 429 and 430 are to divide a constant voltage. The point at which the resistors 429 and 430 are jointed is connected to the noninverting input of a comparator 409 to apply a reference voltage to the noninverting input. Other structure of the embodiment is like the conventional device as shown in FIG. 2.

The operation of the embodiment will be explained. The normal starting operation of an engine by a starter motor is similar to the conventional device. So, the explanation on it will be omitted.

The case where a key switch 6 is returned from the start position to the on position and is set to the start position again before the engine has completely started will be explained.

First, after the key switch has been set to the start position for the first time, the starter motor 2 is being energized while the transistor 410 is conducting. At this time, the voltage at the terminal **4*d* for driving the auxiliary switch 3 is about 1 v because there is a voltage drop in the diode 431**.

The reference voltage of the first detecting means comprising the comparator 425 for detecting the voltage at the auxiliary switch driving terminal **4*d* is set to 0.5 v. The reference voltage of the second detecting means comprising the Zener diode 426 and the transistor 427** is set to 7 v.

As a result, the output of the comparator 425 is "high" and the transistor 427 is not conducting. The resistor 430 is not working as a resistor which sets the reference voltage for the noninverting input of the comparator 409. The voltage at the noninverting input of the comparator 409 is a voltage determined by the resistor 429, the diode 406 and the resistor 407.

The voltage at the inverting input of the comparator 409 is lower than that at the noninverting input by the voltage drop given by the diode 406. The lower voltage is applied across the condenser 408 to charge it. So, the output of the comparator 409 maintains the "high" state.

Second, when the key switch 6 is returned from the start position to the on position, the voltage at the auxiliary switch driving terminal **4*d* drops to 0 v. As a result, the output of the comparator 425 changes to "low". The noninverting input of the comparator 409 receives the reference voltage divided by the resistors 429 and 430, which is lower than the voltage which had been given by the resistor 429, the diode 406 and the resistor 407** until the key switch is returned from the start position to the on position.

However, since the inverting input of the comparator 409 is maintained, by the capacitor 408, at the voltage that had been given until the switching, the voltage at the inverting input becomes higher than that at the noninverting input and the output of the comparator 409 goes to "low" to cut off the transistor 410.

For the reasons, when the key switch 6 is set to the start position again, the voltage at the auxiliary switch driving terminal **4*d* is the same as a voltage output of the battery. As a result, the transistor 427 which is a main element of the second detecting means conducts to maintain the voltage of the noninverting input of the comparator 409 at the reference voltage divided by the resistors 429 and 430. The output of the comparator 409 remains in the "low" state to hold the transistor 410 at cutoff, which prevents the auxiliary switch 3 from being closed to energize the starter motor 2**.

The discharge time constant of the capacitor 408 is decided by the CR time constant which is the multiplication of the values of the capacitor 408 and the resistor 407. The time required for the voltage of the capacitor 408 to lower to the reference voltage by discharging is set to the time required for the inertial rotation of the starter motor 2 to stop, i.e. 3–5 seconds.

As a result, during the time (3–5 seconds) required for the inertial rotation of the starter motor 2 to cease, even if the key switch 6 is set to the starter position, the starter motor 2 is not energized to prevent the pinion from being damaged, which offer a protection effect similar to the conventional device.

Although, in the embodiment, the rotation speed of the generator is detected to carry out detection of the rotation speed of the engine, the rotation speed of the engine can be directly detected, or the rotation speed of other mechanism which is related to the rotation speed of the engine can be detected.

As explained, in accordance with the present invention, the voltage at the auxiliary switch driving terminal which can interrupt the energization to the starter motor is detected by the first and the second detecting means, the open and closing of the auxiliary switch are decided by the results of the detections. As a result, the terminal for detecting the conducting state of the auxiliary switch and the wire-harness to be connected to the terminal are not required, and it is possible to improve quality and to minimize cost. In addition, it is also possible to design and manufacture the auxiliary switch and the control device independently and to facilitate the standardization and maintenance because it is not necessary to constitute the auxiliary switch and control device as one unit.

Obviously, numerous modifications and variations of the present invention are possible in light of the above teachings. It is therefore to be understood that within the scope of the appended claims, the invention may be practiced otherwise than as specifically described herein.

What is claimed is:

1. A starter motor control device comprising:

a starter motor for starting an engine, an auxiliary switch which can interrupt the energization to the starter motor, a circuit for detecting the rotation speed of the engine or other mechanism related to the rotation speed of the engine to output a signal for preventing the starter motor from being conversely driven by the started engine, a circuit for restraining the starter motor from being energized again for a predetermined time just after the energization to the starter motor is cut off, a first detecting means having a first set value for judging the voltage at an auxiliary switch driving terminal for a switching element for driving the auxiliary switch, a second detecting means having a second set value for judging the voltage of the auxiliary switch driving terminal, and a circuit for determining the operation of the switching element based on the judgements given by the first and the second detection means.

* * * * *